US012680249B2

(12) United States Patent
Mattson

(10) Patent No.: US 12,680,249 B2
(45) Date of Patent: Jul. 14, 2026

(54) ACCESSORY MOUNT ASSEMBLY FOR A VEHICLE

(71) Applicant: Polaris Industries Inc., Medina, MN (US)

(72) Inventor: Paul L. Mattson, Harris, MN (US)

(73) Assignee: POLARIS INDUSTRIES, INC., Medina, MN (US)

( * ) Notice: Subject to any disclaimer, the term of this patent is extended or adjusted under 35 U.S.C. 154(b) by 805 days.

(21) Appl. No.: 17/536,569

(22) Filed: Nov. 29, 2021

(65) Prior Publication Data

US 2023/0167618 A1 Jun. 1, 2023

(51) Int. Cl.
*E01H 5/06* (2006.01)

(52) U.S. Cl.
CPC ..... *E01H 5/061* (2013.01)

(58) Field of Classification Search
CPC ..... E02F 3/7627; E02F 3/7631; E02F 3/3604; E02F 3/627; E02F 3/7609; E02F 9/006
See application file for complete search history.

(56) References Cited

U.S. PATENT DOCUMENTS 5,568,694 A * 10/1996 Capra ..... E01H 5/06 37/231
7,950,486 B2 5/2011 Van et al.
8,065,822 B2 * 11/2011 Maas ..... E01H 5/061 37/231
8,151,493 B2 4/2012 Dilworth et al.
10,486,616 B2 11/2019 Lauziere et al.
2008/0115392 A1 * 5/2008 Musso ..... E01H 5/06 37/231
2021/0062465 A1 3/2021 Aubin-Marchand et al.

OTHER PUBLICATIONS

"2018 Argo Xplorer XR 500 Recreational ATV—Walkaround—2018 Toronto ATV Show", available at https://www.youtube.com/watch?v=EZRP5fBbm8g; 1 page.
Screen captures from YouTube video clip entitled "Full Review | 2020 Tiffin Wayfarer 25RW | Class C RV With a Massive Slideout" 13 pages, posted on Jul. 4, 2019. Visited on Jun. 9, 2021. https://www.youtube.com/watch?v=4tn2gGTB4L8.

* cited by examiner

*Primary Examiner* — Joseph M Rocca
*Assistant Examiner* — Robert E Pezzuto
(74) *Attorney, Agent, or Firm* — SCHWEGMAN LUNDBERG & WOESSNER, P.A.

(57) ABSTRACT

A plow mount assembly shown herein is positioned on a side-by-side vehicle configured to selectively attach and detach. The plow system may selectively engage mounting bars located on a vehicle subframe through the movement of a lever arm and may further be locked into place through a plurality of pins and apertures. Further, the plow system may be vertically positionable through a series of vertically spaced mounting holes allowing for the vehicle herein to be a variety of different heights due to frame configuration and/or varying heights of ground engaging members.

20 Claims, 13 Drawing Sheets

ACCESSORY MOUNT ASSEMBLY FOR A VEHICLE

FIELD OF THE DISCLOSURE

The present disclosure relates to plows and plow frames and, more particularly, connecting a plow frame to a vehicle.

BACKGROUND OF THE DISCLOSURE

Plows are an important accessory to vehicles and are frequently utilized to efficiently and effectively move material. Some plows are fixedly coupled to vehicles in a permanent manner while other plows are designed for easily coupling and uncoupling to vehicles. Some methods of coupling and uncoupling plows from vehicles are known, and oftentimes these methods include the use of a winch and a winch cable to help maintain tension and alter a height characteristic of the plow.

SUMMARY OF THE DISCLOSURE

In one embodiment, a plow system for a vehicle comprises a main frame and a blade operably coupled to the main frame. The main frame comprises a first mounting portion and a second mounting portion configured to couple with the vehicle, and a lever operably coupled with the main frame, wherein the lever is configured to move from a first position to a second position. When the lever is in the first position, the lever covers both the first mounting portion and the second mounting portion, and when the lever is in the second position, the lever allows access to both the first mounting portion and the second mounting portion.

In another embodiment, an implement mounting system for a vehicle comprises a main frame configured to receive an implement at a forward end of the main frame. Further, the implement mounting system comprises a vehicle subframe that is configured to receive the main frame, and at least one adjustment bracket coupled to the main frame. The at least one adjustment bracket comprises a plurality of mounting holes, and a lever is coupled to the adjustment bracket, wherein a portion of the lever is configured to engage the vehicle subframe.

In yet another embodiment, a frame assembly for coupling an accessory to a vehicle comprises a main frame which comprises a front portion and a rear portion. The accessory is configured to be coupled to the main frame adjacent to the front portion, and the accessory has an adjustable height relative to the ground when coupled to the main frame. Additionally, at least one adjustment bracket coupled to the rear portion and the adjustment bracket comprises a plurality of adjustment bracket apertures. Further, the rear portion comprises a plurality of main frame apertures, and at least a first portion of the adjustment bracket apertures are configured to align with at least a first portion of the main frame apertures in a first position giving the accessory a first height relative to the ground. Further, at least a second portion of the adjustment bracket apertures are configured to align with at least a second portion of the main frame apertures in a second position giving the accessory a second height relative to the ground. Finally, the first height is distinct from the second height.

DETAILED DESCRIPTION OF THE DRAWINGS

Figure 1:
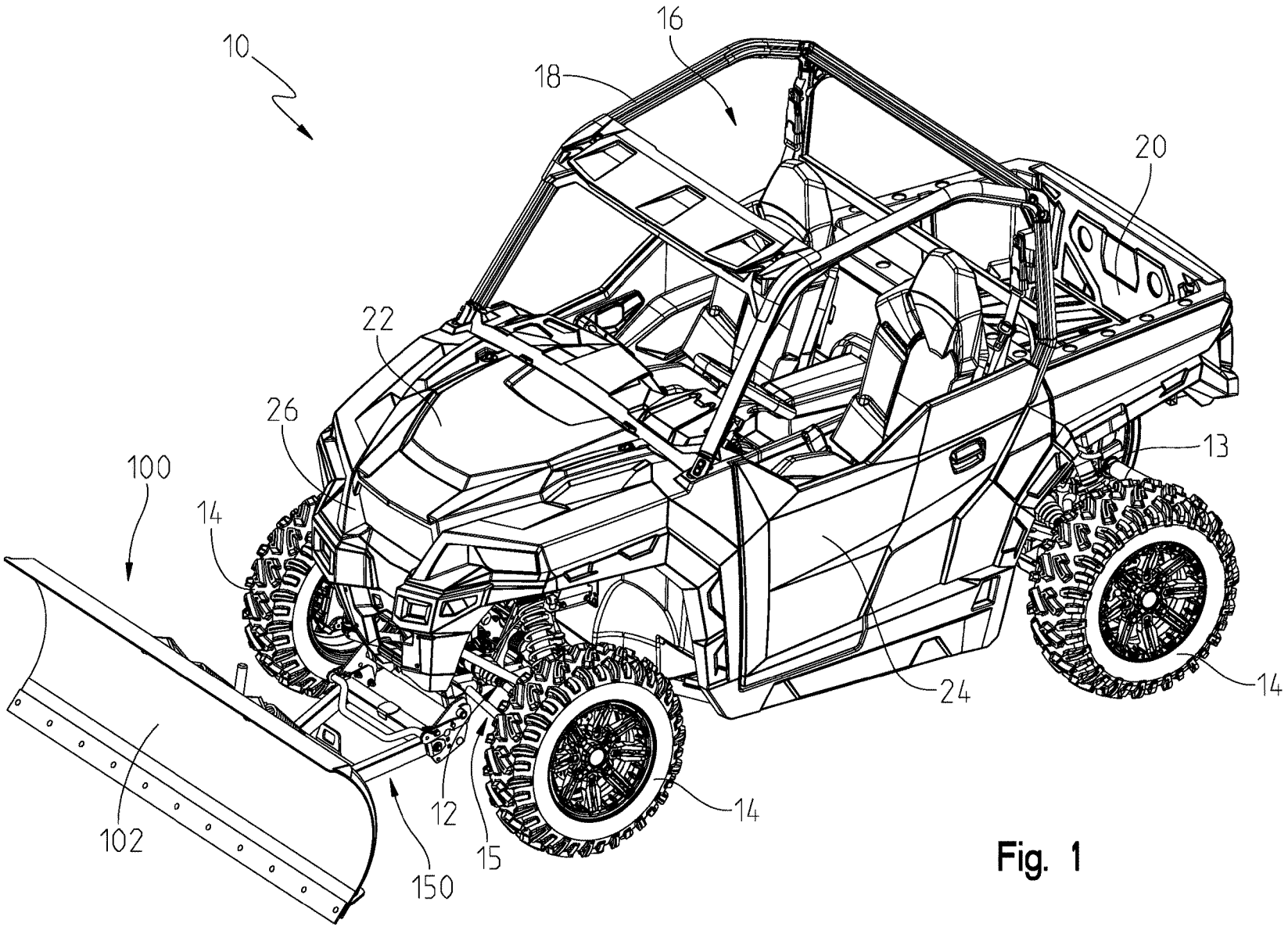
FIG. 1 shows a front left perspective view of a vehicle having a plow system of the present disclosure.

For the purposes of promoting an understanding of the principles of the present disclosure, reference is now made to the embodiments illustrated in the drawings, which are described below. The embodiments disclosed below are not intended to be exhaustive or limit the present disclosure to the precise form disclosed in the following detailed description. Rather, the embodiments are chosen and described so that others skilled in the art may utilize their teachings. Therefore, no limitation of the scope of the present disclosure is thereby intended. Corresponding reference characters indicate corresponding parts throughout the several views.

The terms "couples", "coupled", "coupler", and variations thereof are used to include both arrangements wherein two or more components are in direct physical contact and arrangements wherein the two or more components are not in direct contact with each other (e.g., the components are "coupled" via at least a third component, but yet still cooperates or interact with each other).

In some instances throughout this disclosure and in the claims, numeric terminology, such as first, second, third, and fourth, is used in reference to various operative apertures, holes and other components and features. Such use is not intended to denote an ordering of the components. Rather, numeric terminology is used to assist the reader in identifying the component being referenced and should not be narrowly interpreted as providing a specific order of components.

As shown in FIG. 1, a plow system 100 is operably coupled to a vehicle 10. Plow system 100 includes a blade 102 facing generally forward relative to vehicle 10. Vehicle 10 is illustratively shown as a side-by-side recreational and utility vehicle, but it is understood that vehicle 10 may be any vehicle capable of receiving and appropriately utilizing plow system 100. As shown in FIG. 1, vehicle 10 comprises a front suspension 12 operably coupled to at least some ground engaging members 14 and a steering system 15 configured to steer ground engaging members 14. Ground engaging members 14 may be wheels, skis, tracks, or other suitable components configured to move vehicle 10 along the ground. In an exemplary embodiment, vehicle 10 further comprises an operator area 16 surrounded by an upper frame portion 18. Operator area 16 is located forward of a cargo area 20, and cargo area 20 is located vertically above a rear suspension 13. Vehicle 10 may further comprise a plurality of body panels including at least a hood 22 extending forward of operator area 16, a driver door 24 for allowing ingress and egress to operator area 16, and a front fascia 26.

Figure 2:
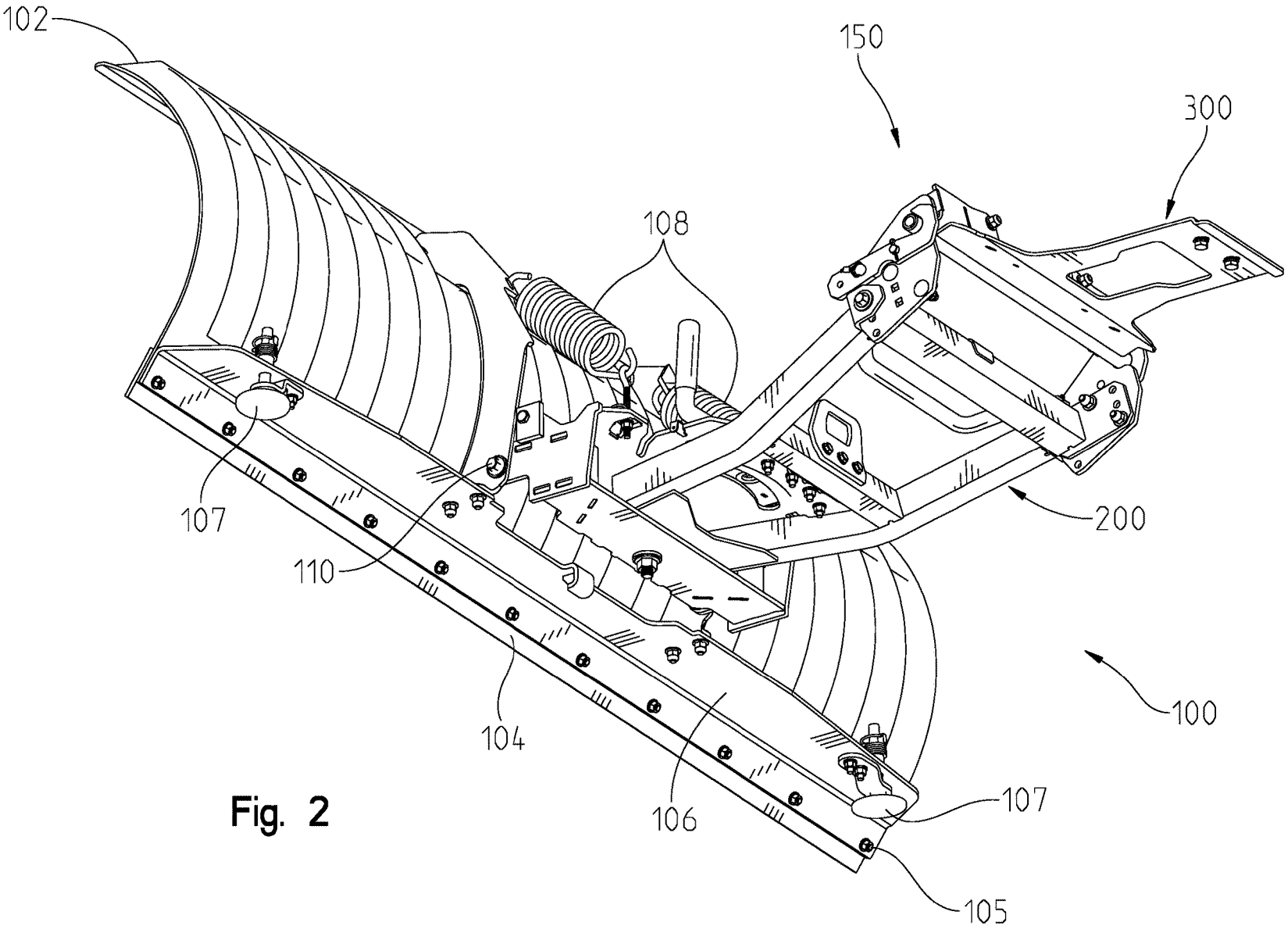
FIG. 2 shows a left rear perspective view of the plow assembly of FIG. 1.

Plow system 100 will now be explained in greater detail. As seen in FIG. 2, plow system 100 comprises blade 102 and a plow frame 150. Plow frame 150 is operably coupled to blade 102 through a plurality of connections including a plurality of biasing members 108 and a plurality of fasteners 110. Blade 102 is coupled to or includes a wear strip 104 and a plurality of fasteners 105 may be used to couple wear strip 104 to blade 102. Blade 102 further comprises a back plate 106 configured to provide rigidity to the bottom of blade 102 when in use. Back plate 106 further comprises a plurality of shoes 107 configured to adjust vertically to assist the blade in engaging the ground effectively. Plow frame 150 is illustratively coupled to blade 102 generally at the front portion of plow frame 150. Plow frame 150 generally comprises a plow subframe 200 and a vehicle subframe 300.

Turning to FIGS. 3 through 7, the connection method of plow subframe 200 to vehicle subframe 300 will be explained. Plow subframe 200 comprises a main frame 210 and a pair of first or large mating brackets 212 and a pair of second or small mating brackets 214. Illustratively, large mating brackets 212 comprise a left large mating bracket 212L and a right large mating bracket 212R, and small mating brackets 214 comprise a left small mating bracket 214L and a right small mating bracket 214R. An opening 211 is defined within a portion of main frame 210 and configured to receive a winch hook. More particularly, opening 211 is defined within a bracket 209 of main frame 210. In this way, a winch hook may pull up on bracket 209 and vertically move plow system 100.

Figure 3:
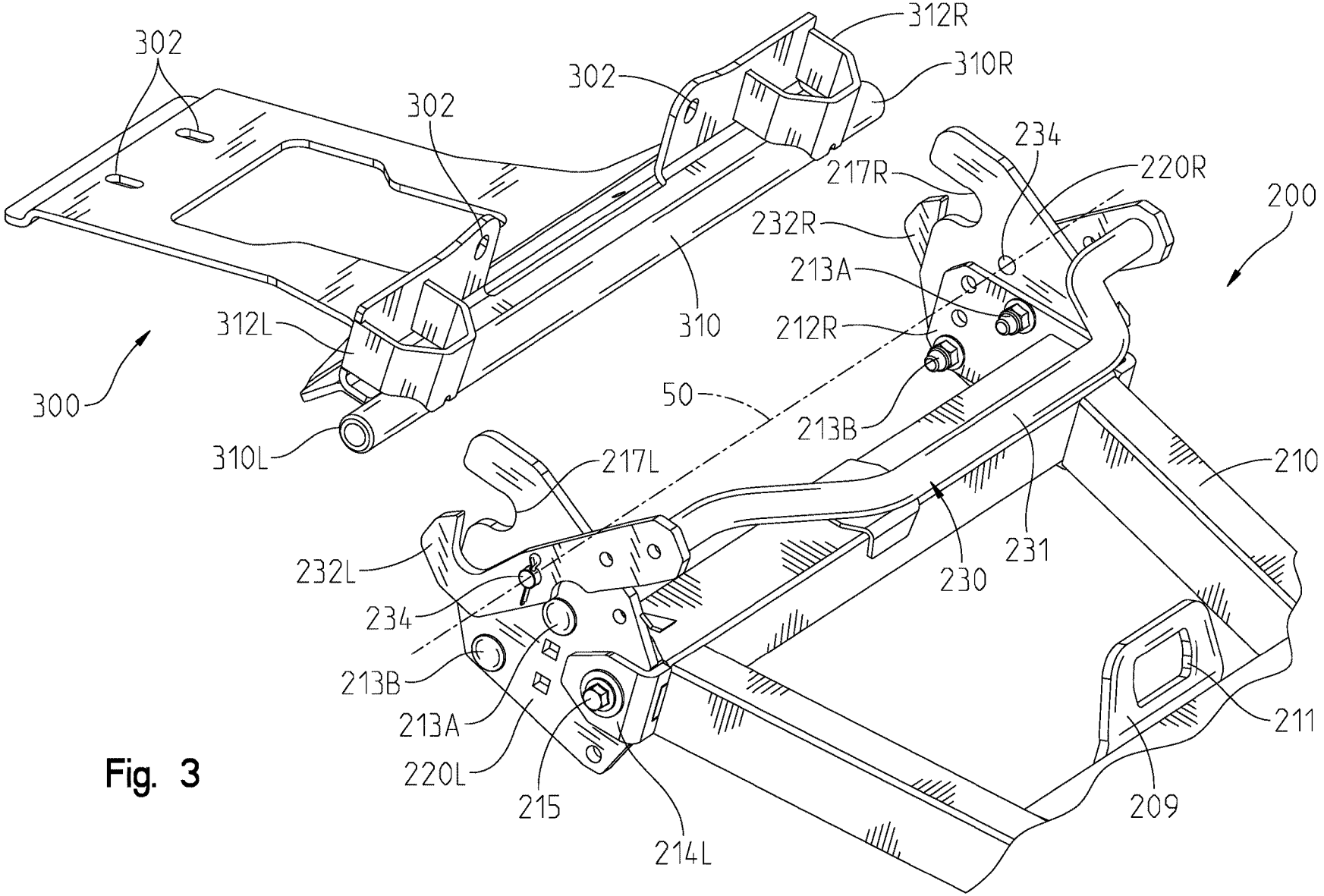
FIG. 3 shows an exploded view of a connection between a main frame and a subframe of the plow system of FIG. 1 with the connection in an unengaged configuration.

As shown in FIG. 3, a pair of main mounting plates 220 are operably coupled to main frame 210 through a first set of fasteners 213, including a first fastener 213A and a second fastener 213B, and a third fastener 215. Illustratively, a left main mounting plate 220L and a right main mounting plate 220R are coupled using first fastener 213A, second fastener 213B, and a third fastener 215 in a mirrored fashion. That is, left main mounting plate 220L is coupled to left small mating bracket 214L using third fastener 215 and left main mounting plate 220L is coupled to left large mating bracket 212L through first fastener 213A and second fastener 213B. Similarly, right main mounting plate 220R is coupled to right small mating bracket 214R using another corresponding third fastener 215 and right main mounting plate 220R is coupled to right large mating bracket 212R through another set of corresponding first fastener 213A and second fastener 213B.

Main mounting plates 220 are configured with a pair of mount receivers 217, illustratively, left main mounting plate 220L comprises a left mount receiver 217L and right main mounting plate 220R comprises a right mount receiver 217R. A lever 230 is configured to couple to main mounting plates 220 through a pair of pins 234. Illustratively, lever 230 is configured to rotate about pins 234 creating a lever rotation axis 50. Notably, the lever rotation axis 50 intersects the left main mounting plate 220L and the right main mounting plate 220R. Pins 234 may be retained in a variety of methods, for example, in an exemplary embodiment, a cotter pin is used to retain pins 234. Lever 230 comprises a main lever arm 231, a left lever arm 232L, and a right lever arm 232R. In an exemplary embodiment, left lever arm 232L is coupled to left main mounting plate 220L and right lever arm 232R is coupled to right main mounting plate 220R. In an exemplary embodiment, left lever arm 232L and right lever arm 232R are generally in the shape of a hook and configured to interface with mount receivers 217.

Figure 5:
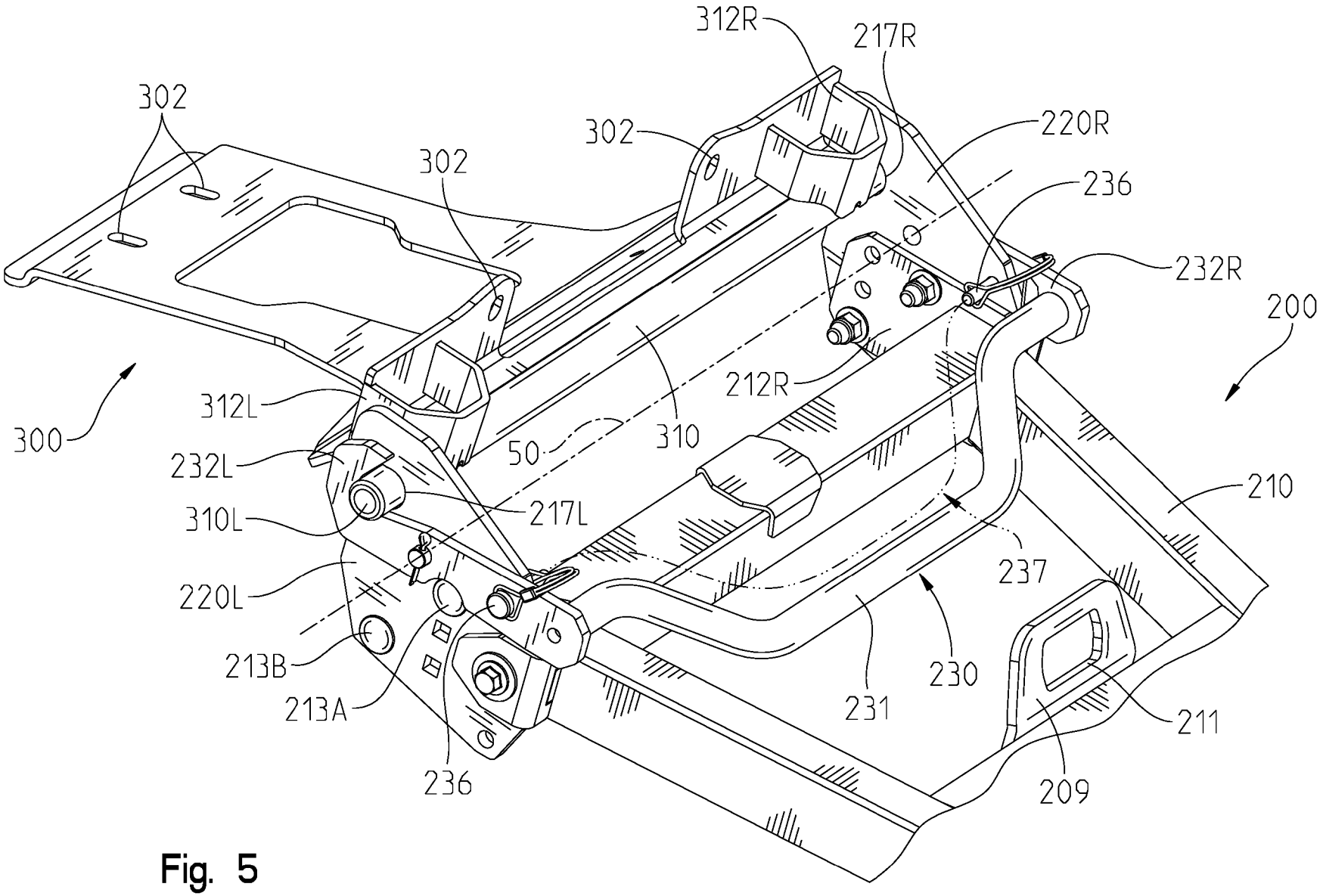
FIG. 5 shows an exploded view of a connection between a main frame and a subframe of the plow system of FIG. 1 with the connection in an engaged configuration.
Figure 10:
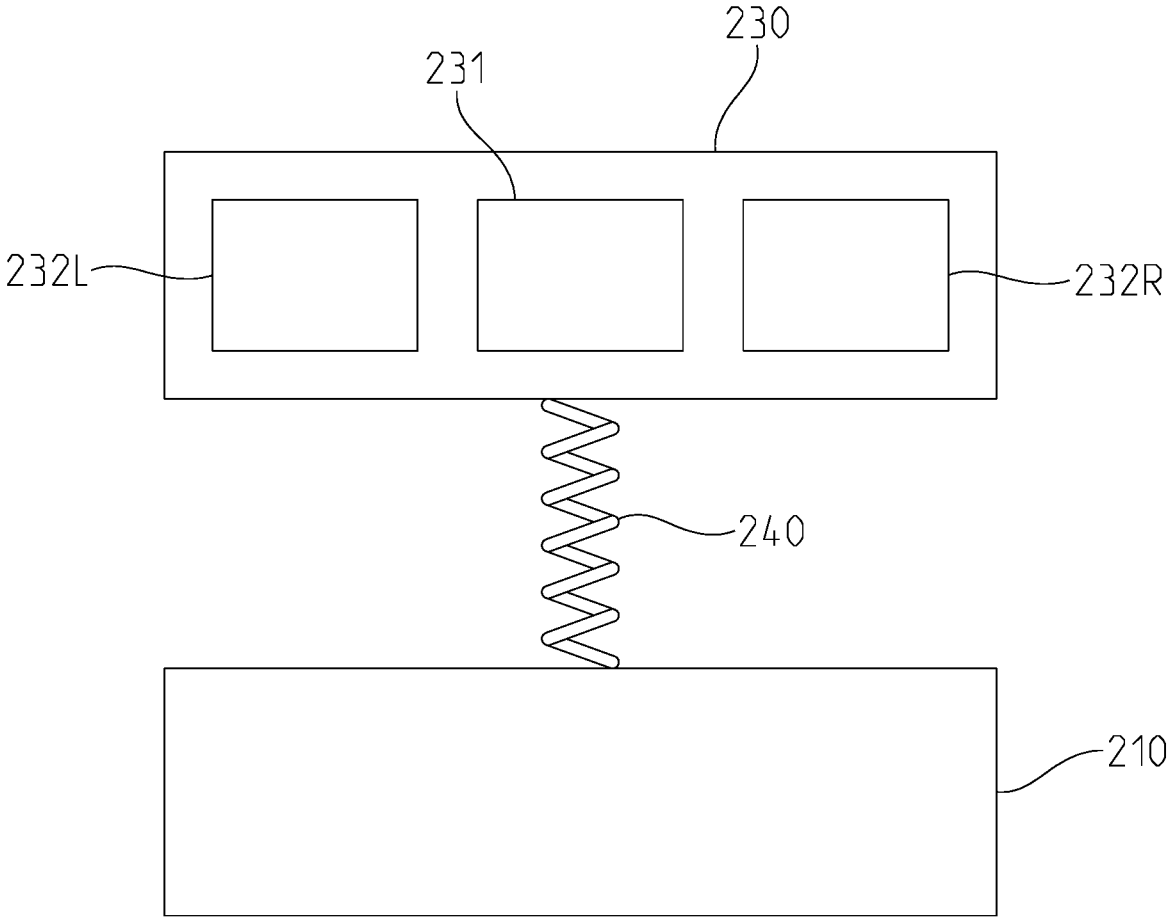
FIG. 10 shows a schematic view of an alternate embodiment of the lever mechanism of the plow system of FIG. 1.

Referring to FIG. 10, in an alternate embodiment, it is conceived that lever 230 may comprise a biasing member 240 coupled between lever 230 and main frame 210. Biasing member 240 may be a spring, a shock absorber, or other suitable member that may bias lever 230 towards or away from main frame 210. In an alternate embodiment, the biasing member 240 may be connected at a middle portion of lever 230, in the middle of main lever arm 231, and connected downward to main frame 210. In this alternate embodiment, the biasing member 240 may be configured to bias the lever 230 in a downward direction, towards the main frame 210, so that mount receivers 217 remain unobstructed (as shown in FIG. 3). It is conceived that lever 230 may be biased in an upward direction so that the natural state of lever 230 is to obstruct mount receivers 217 (as shown in FIG. 5).

Still referring to FIG. 10, in yet another alternate embodiment, a biasing member (not shown) may be placed on either side of lever 230. A biasing member may be coupled between left lever arm 232L and left main mounting plate 220L such that lever 230 is biased in a downward direction towards main frame 210 and mount receivers 217 remain open. Biasing member may further be coupled between left lever arm 232L and main frame 210. It is conceived that a biasing member may be located on only one side of plow system 100, such as the left side or right side, or a biasing member may be located on both the left side and right side of plow system 100.

Figure 11:
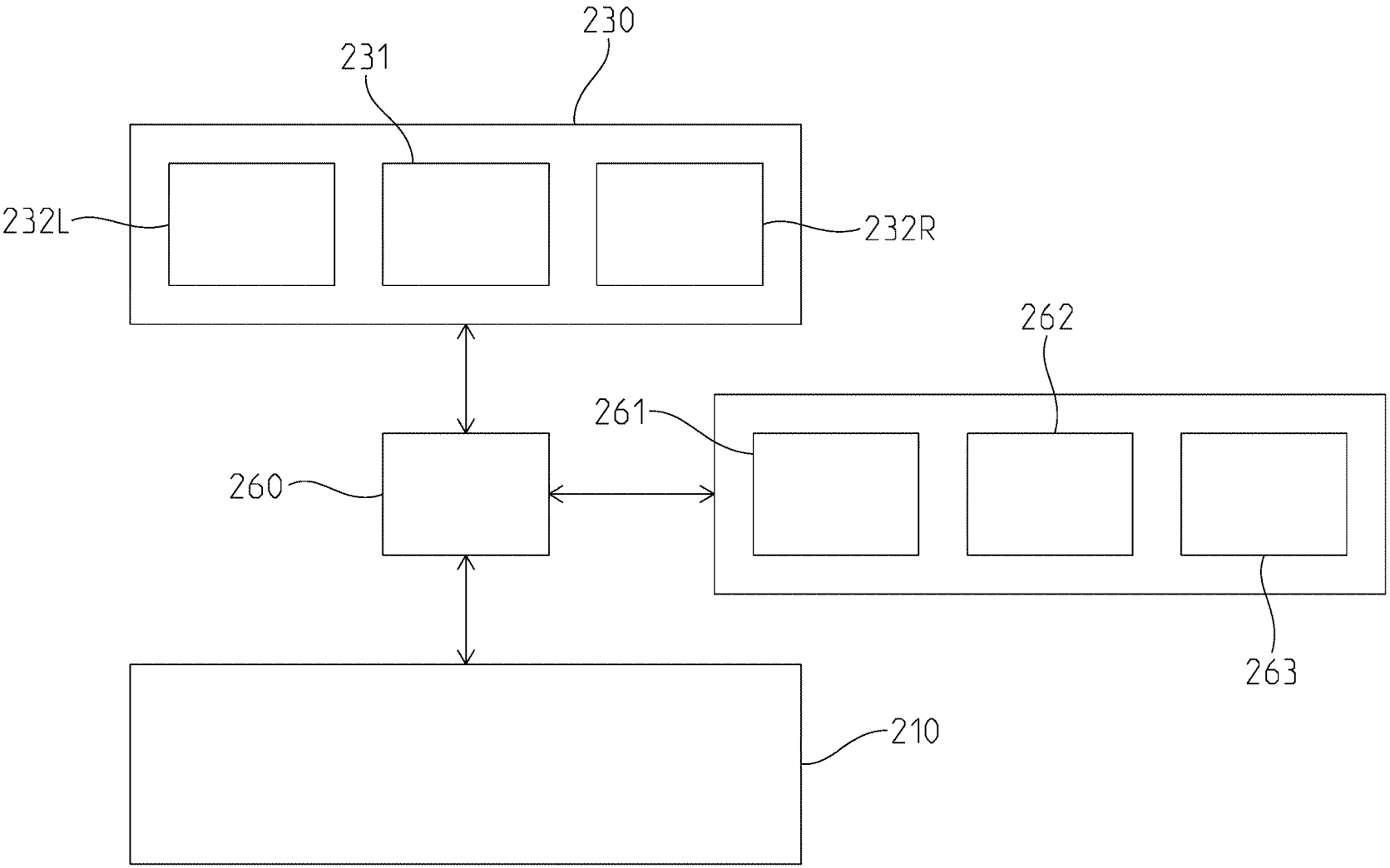
FIG. 11 shows a schematic view of an alternate embodiment of the lever mechanism of the plow system of FIG. 1.

Now referring to FIG. 11, in yet another embodiment, it is conceived that biasing member 240 as previously recited may be replaced by an actuator 260. In various embodiments, actuator may be a mechanical linkage, a motor, a magnet or the like. In this way, active control of the position of lever 230 may be controlled either manually or automatically. Actuator 260 may be controlled via a user interface 261. User interface 261 may comprise a plurality of methods, including but not limited to an instrument panel on the plow system 100, a remote control linked to the plow system 100, a wireless method such as a mobile device, or display within vehicle 10 that may include knobs, switches, touch displays, sliders, or the like. Actuator 230 may further be operably coupled to a controller 262 and a power source 263.

As is further shown in FIG. 3, vehicle subframe 300 is configured to couple to vehicle 10 through a plurality of fasteners (not shown) inserted through opening 302 to couple to vehicle 10. Vehicle subframe 300 generally extends under vehicle 10, and generally underneath front suspension 12 and steering system 15, more specifically, vehicle subframe 300 may extend from a position behind steering system 15 of vehicle 10 to a position in front of front suspension 12. Vehicle subframe 300 further comprises a mounting rod 310, including a left mounting portion 310L and a right mounting portion 310R. In an exemplary embodiment, mounting rod 310 is a continuous shaft extending a lateral width greater than the vehicle subframe. Mounting rod 310 is coupled to a left support bracket 312L and a right support bracket 312R. Vehicle subframe 300 may be configured in a variety of ways to accommodate the frames of multiple types of vehicle 10, as disclosed in greater detail hereinafter.

The configuration shown in FIG. 3 illustrates a disengaged configuration of plow system 100 where plow subframe 200 is not coupled to and is spaced apart from vehicle subframe 300. As shown, lever 230 is shown in a disengaged position where left lever arm 232L and right lever arm 232R are positioned vertically lower than mount receivers 217 such that access to mount receivers 217 is unimpeded. In this way, mounting rod 310 is free to engage with mount receivers 217, that is left mounting portion 310L may engage left mount receiver 217L and right mounting portion 310R may engage right mount receiver 217R thus coupling vehicle subframe 300 and plow subframe 200 when plow system 100 is in an engaged configuration, as disclosed further herein.

Figure 4:
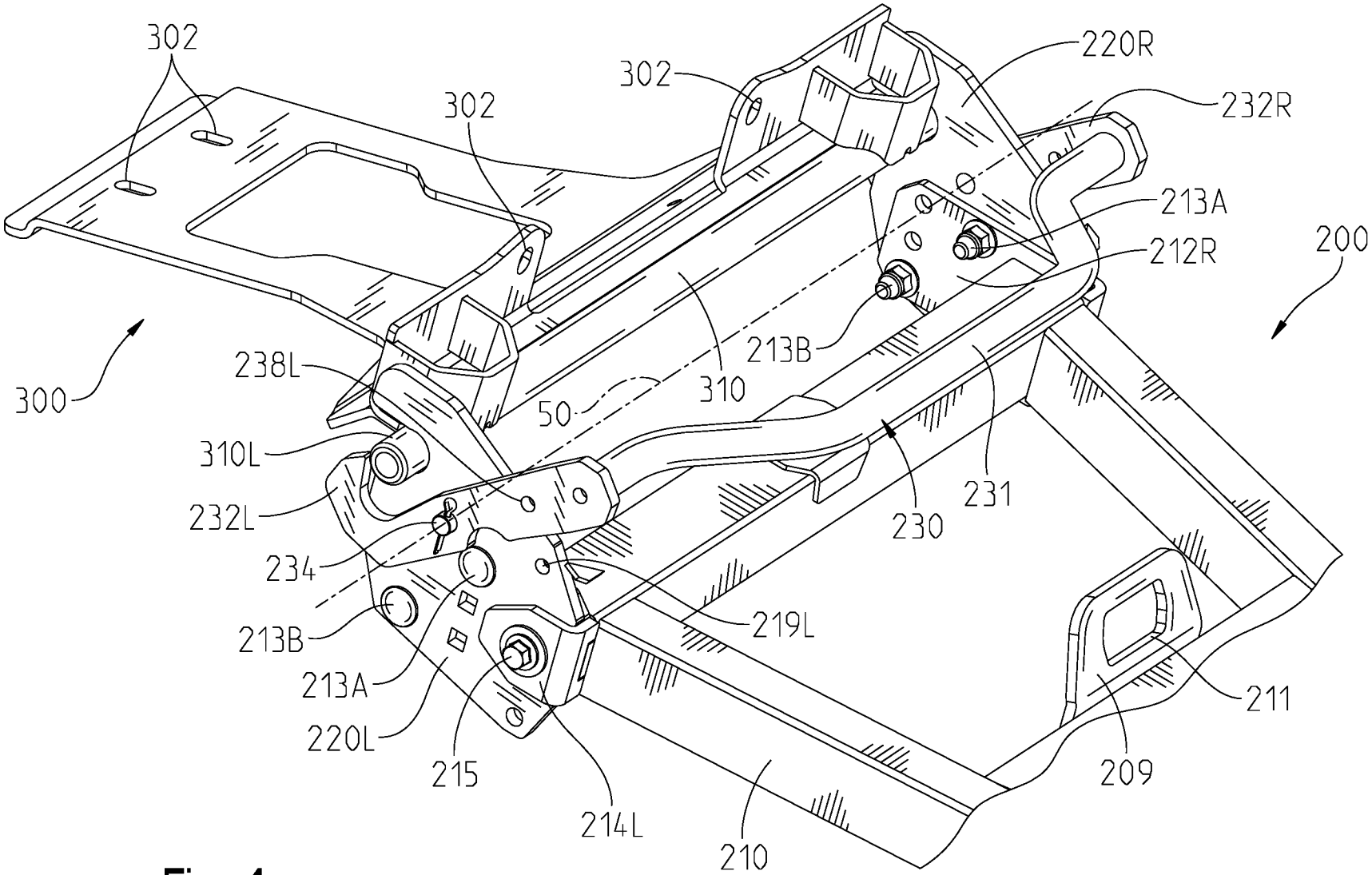
FIG. 4 shows an exploded view of a connection between a main frame and a subframe of the plow system of FIG. 1 with the connection in a partially engaged configuration.

As is shown in FIG. 4, a partially engaged configuration is shown. Illustratively, left mounting portion 310L engages left mount receiver 217L and right mounting portion 310R engages right mount receiver 217R and lever 230 is allowed to rotate around lever rotation axis 50. In an exemplary embodiment, mounting rod 310 has a circular cross section and mount receivers 217 are rounded, however it should be understood that any complementary pair of shapes may be used. As can be best seen in FIG. 5, inner side of left main mounting plate 220L engages with outer edge of left support bracket 312L and inner side of right main mounting plate 220R engages with the outer edge of right support bracket 312R. In the present embodiment, left main mounting plate 220L is configured to engage left support bracket 312L and right main mounting plate 220R is configured to engage right support bracket 312R such that the tolerance between these components is small. The small tolerance promotes a tight fit, discouraging any slack or extra tolerance in a lateral direction of plow system 100. In this way, plow system 100 is able to receive lateral loads better.

Still referring to FIG. 5, a fully engaged configuration is shown. In this configuration, lever 230 is rotated about lever rotation axis 50 to a farthest rotational position such that left mounting portion 310L and right mounting portion 310R are received into left mount receiver 217L and right mount receiver 217R, respectively. Once in the engaged configuration, lever 230 may be locked using a pin 236 inserted through pin aperture 219L and lever aperture 238L (FIG. 4). It should be understood that lever 230 may lock using a single pin 236 or a plurality of pins. In an exemplary embodiment, pin 236 is a wire locking pin, however it is conceived that any locking pin that locks lever 230 in place would be suitable. In this engaged position, vehicle subframe 300 and plow subframe 200 are operably coupled together and loads may be transmitted from plow subframe 200 to vehicle subframe 300 and on to the vehicle 10 to reduce the load at blade 102 and distribute the load throughout the frame of vehicle 10.

Figure 6:
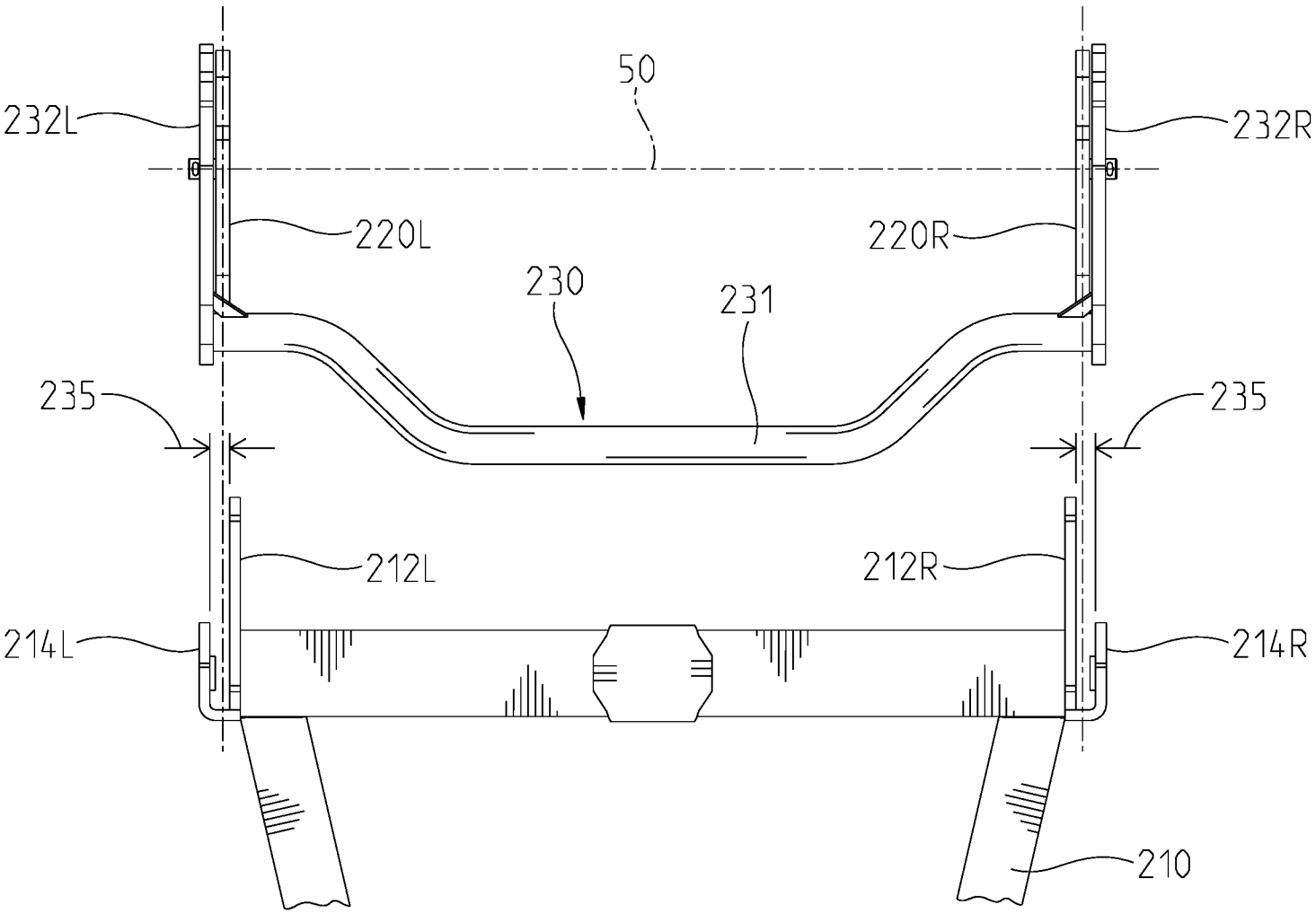
FIG. 6 shows a top exploded view of the main frame of the plow system of FIG. 1.

As can be seen in FIG. 6, left main mounting plate 220L and right main mounting plate 220R are configured to insert into apertures defined by a width 235 between left small mating bracket 214L and left large mating bracket 212L and between right small mating bracket 214R and right large mating bracket 212R. In an exemplary embodiment, the width of main mounting plates 220 is approximately the same as width 235 such that an optimal clamping load can be achieved by first fastener 213A, second fastener 213B, and third fastener 215 and an initial tolerance or mechanical interference fit may help to maintain mounting plates 220L, 220R within the aperture while applying fasteners 213A, 213B, 215.

In a further embodiment, lever 230 may further comprise a biasing member, such as a torsion spring, aligned to rotate along lever rotation axis 50. In this way, biasing member would be coupled to lever 230 and main mounting plates 220 such that lever 230 would be biased to rotate relative to main mounting plates 220. In this way, lever 230 would not require a pin 236 and would move from an engaged position to a disengaged position automatically.

In yet another embodiment, pins 236 may be spring loaded (not shown). Spring loaded pins may be retained on either main mounting plates 220 or retained on lever arms 232. In this way, pins 236 are integral to the assembly and are less likely to be misplaced, and assembly of lever 230 to main mounting plates 220 may be simplified. Spring loaded pins may be configured such that they are biased into engagement. That is, if a spring-loaded pin is retained on left main mounting plate 220L, it would be biased into engagement with left lever arm 232L. A similar assembly may be located on the right side of plow system 100. It is further conceived that a cable 237 might stretch between spring loaded pins 236 and may be configured to control the engagement of pins 236 and run adjacent along at least a portion of main lever arm 231. When a user (not shown) positions themselves to actuate lever 230, cable 237 is placed adjacent at least a portion of main lever arm 231 so that the user can easily actuate pins 236 through cable 237 so that pins 236 may be disengaged so that lever 230 may rotate about lever rotation axis 50. A perceived benefit of the present embodiment is that a user may use a single hand, or two hands, to actuate cable 237 and lever 230.

In yet a further embodiment, lever 230 may contain an electric motor operably coupled to lever 230 about lever rotation axis 50 such that lever 230 would rotate in response to the operation of the electric motor. The electric motor may be any suitable electric motor, such as a stepper motor, a servo motor, a direct drive motor, or any type of brushless or brushed motor. It is also contemplated that a mechanical linkage may be utilized that is connected to any other type of electric motor, such as a linear motor. A motor may be operated via a control panel located on plow assembly 100, or may further be controlled by a remote, a mobile device, a user interface within vehicle 10, or by a plurality of other inputs such as knobs, sliders, switches, etc.

Figure 7:
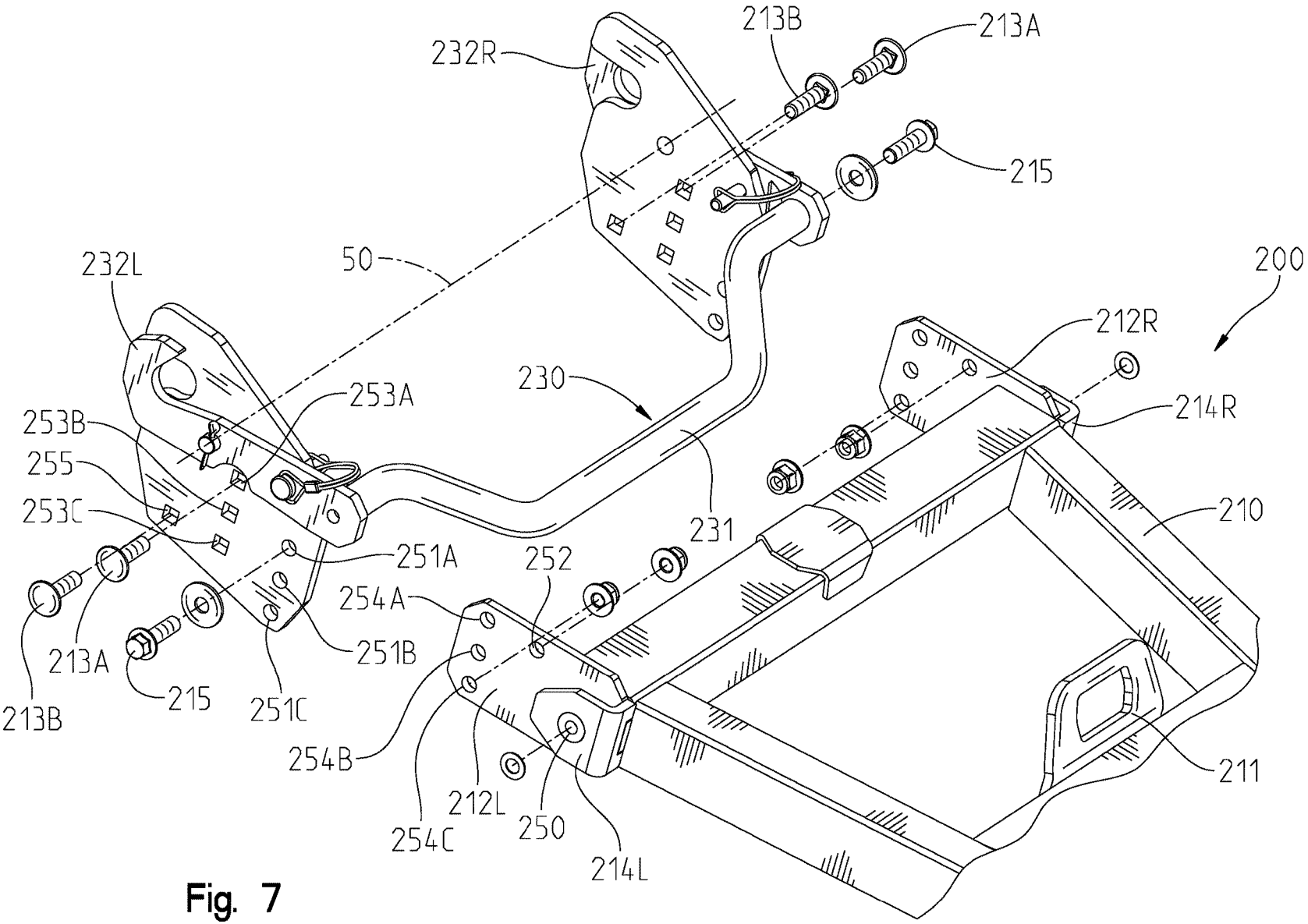
FIG. 7 shows a perspective exploded view of the main frame of the plow system of FIG. 1.

Turning now to FIG. 7, the adjustment features of plow system 100 will be explained in greater detail. Illustratively, the adjustment features of plow system 100 allow plow subframe 200 to be adjusted vertically relative to vehicle subframe 300. In this way, the vertical height of blade 102 is adjusted allowing vehicle 10, or ground engaging members 14, to be various heights and still work with plow system 100. Illustratively, adjustment of plow system 100 is achieved through the use of a plurality of adjustment apertures configured to cooperate with each other. In the present invention, a first adjustment aperture 250 cooperates with one of a plurality of second adjustment apertures 251 including a second upper adjustment aperture 251A, a second middle adjustment aperture 251B, and a second lower adjustment aperture 251C. Similarly, a third adjustment aperture 252 is configured to cooperate with one of a plurality of fourth adjustment apertures 253 including a fourth upper adjustment aperture 253A, a fourth middle adjustment aperture 253B, and a fourth lower adjustment aperture 253C. Similarly, a plurality of fifth adjustment apertures 254, including a fifth upper adjustment aperture 254A, a fifth middle adjustment aperture 254B, and a fifth lower adjustment aperture 254C, are each configured to cooperate in turn with a sixth adjustment aperture 255.

In an exemplary embodiment, first adjustment aperture 250 is positioned on small mating brackets 214, third adjustment aperture 252 and fifth adjustment apertures 254 are positioned on large mating brackets 212. Further, second adjustment apertures 251, fourth adjustment apertures 253, and sixth adjustment aperture 255 are all located on main mounting plates 220. As can be seen in FIG. 7, the various adjustment apertures are vertically spaced from each other. Illustratively, second lower adjustment aperture 251C is located vertically lower than second middle adjustment aperture 251B which is located vertically lower than second upper adjustment aperture 251A. Similarly, fourth lower adjustment aperture 253C is located vertically lower than fourth middle adjustment aperture 253B which is located vertically lower than fourth upper adjustment aperture 253A. Similarly, fifth lower adjustment aperture 254C is located vertically lower than fifth middle adjustment aperture 254B which is located vertically lower than fifth upper adjustment aperture 254A. As can be best seen in FIG. 8, main frame 210 is angled forward and downwardly.

Demonstrably, the three sets of adjustment apertures, namely, second adjustment apertures 251, fourth adjustment apertures 253, and sixth adjustment aperture 255 align with corresponding adjustment apertures including first adjustment aperture 250, third adjustment aperture 252, and fifth adjustment apertures 254. The adjustment apertures are aligned such that three fasteners are used in each adjustment position, and in an exemplary embodiment there are three adjustment positions corresponding to a first or lowest adjustment position of blade 102, a second or intermediate adjustment position of blade 102, and a third or highest adjustment position of blade 102. In this way, when plow system 100 is adjusted, height of blade 102 is adjusted relative to the ground.

In a first or lowest adjustment position, blade 102 will be located in the lowest position and third fastener 215 is positioned in first adjustment aperture 250 and corresponding second lower adjustment aperture 251C, first fastener 213A is positioned in third adjustment aperture 252 and corresponding fourth lower adjustment aperture 253C and second fastener 213B is positioned in fifth upper adjustment aperture 254A and corresponding sixth adjustment aperture 255.

In a second or intermediate adjustment position, blade 102 will be located in a generally middle position and third fastener 215 is positioned in first adjustment aperture 250 and corresponding second middle adjustment aperture 251B, and first fastener 213A is positioned in third adjustment aperture 252 and corresponding fourth middle adjustment aperture 253B and second fastener 213B is positioned in fifth middle adjustment aperture 254B and corresponding sixth adjustment aperture 255.

In a third or highest adjustment position, blade 102 will be located in a highest position and third fastener 215 is positioned in first adjustment aperture 250 and corresponding second upper adjustment aperture 251A, and first fastener 213A is positioned in third adjustment aperture 252 and corresponding fourth upper adjustment aperture 253A and second fastener 213B is positioned in fifth lower adjustment aperture 254C and corresponding sixth adjustment aperture 255.

Figure 8:
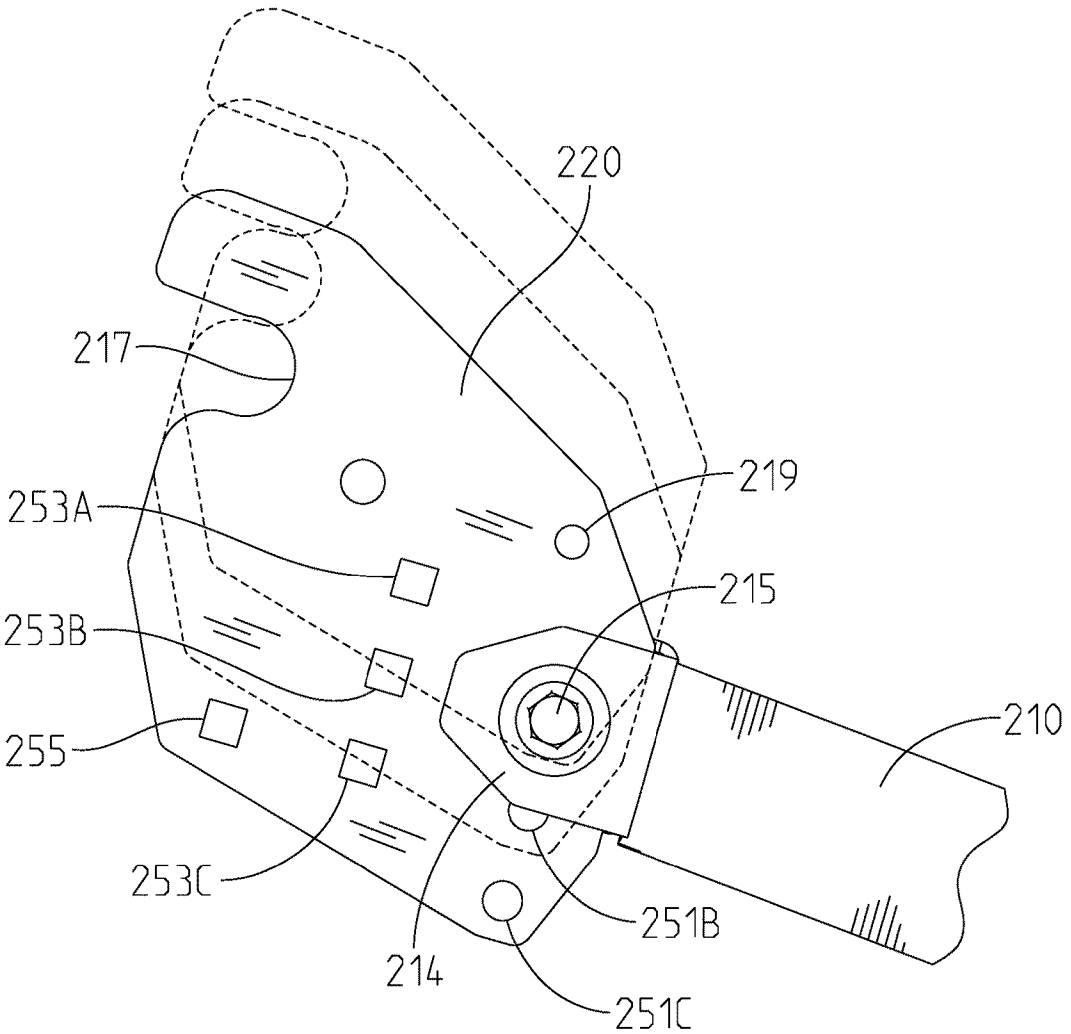
FIG. 8 shows a side view of the main frame of the plow system of FIG. 1.

As can be seen in FIG. 8, the illustrated embodiment has three discrete positions. It should be understood that while this is an exemplary embodiment, any number of discrete positions may be achieved through the use of additional adjustment apertures vertically spaced from the current adjustment apertures.

In a further embodiment, it is conceived that main mounting plates 220 and large mating brackets 212 may comprise channels that replace the plurality of adjustment apertures disclosed herein, including second adjustment apertures 251, fourth adjustment apertures 253, and fifth adjustment apertures 254. In this way, adjustment may be infinite between an upper end and lower end of the described channels, providing additional adjustability for the position of blade 102. In an embodiment comprising channels, a locking slider may be used to effectively move plow subframe 200 relative to vehicle subframe 300.

In yet another embodiment, main mounting plates 220 may be inverted (not shown) so that a plurality of additional heights of plow system 100 might be achieved. First adjustment apertures 250, second adjustment apertures 251, third adjustment aperture 252, fourth adjustment apertures 253, fifth adjustment apertures 254, and sixth adjustment aperture 255 are created such that engagement between main mounting plates 220 and main frame 210 may be achieved whether main mounting plates are configured as displayed, or if they are inverted so that mount receivers 217 are positioned facing away from blade 102 on the lower end of main mounting plates 220. In various embodiments, third adjustment aperture 252 and sixth adjustment aperture 255 may comprise a plurality of additional vertically offset apertures.

As can be seen in FIGS. 9A-9E, a variety of vehicle subframes are described. It should be understood that with a variety of vehicle subframes provided, a standard plow subframe 200 may be provided that might fit with a variety of vehicles, each configured to fit with a different vehicle subframe 300. Illustratively, each vehicle subframe 300 shown in FIGS. 9A-9E share similar base components. For example, each vehicle subframe comprises at least mounting rod 310 with left mounting portion 310L and right mounting portion 310R, in addition to openings 302 configured to receive fasteners (not shown) to couple vehicle subframe 300 to vehicle 10. Vehicle subframe 300 may be a removable component that is easily and quickly removable from vehicle 10 or may also be a component permanently fixed to vehicle 10. In an exemplary embodiment, fasteners (not shown) inserted through openings 302 are removable fasteners so that vehicle subframe 300 is generally removable. The differences between the various presented vehicle subframes will be explained in greater detail below.

Figure 9A:
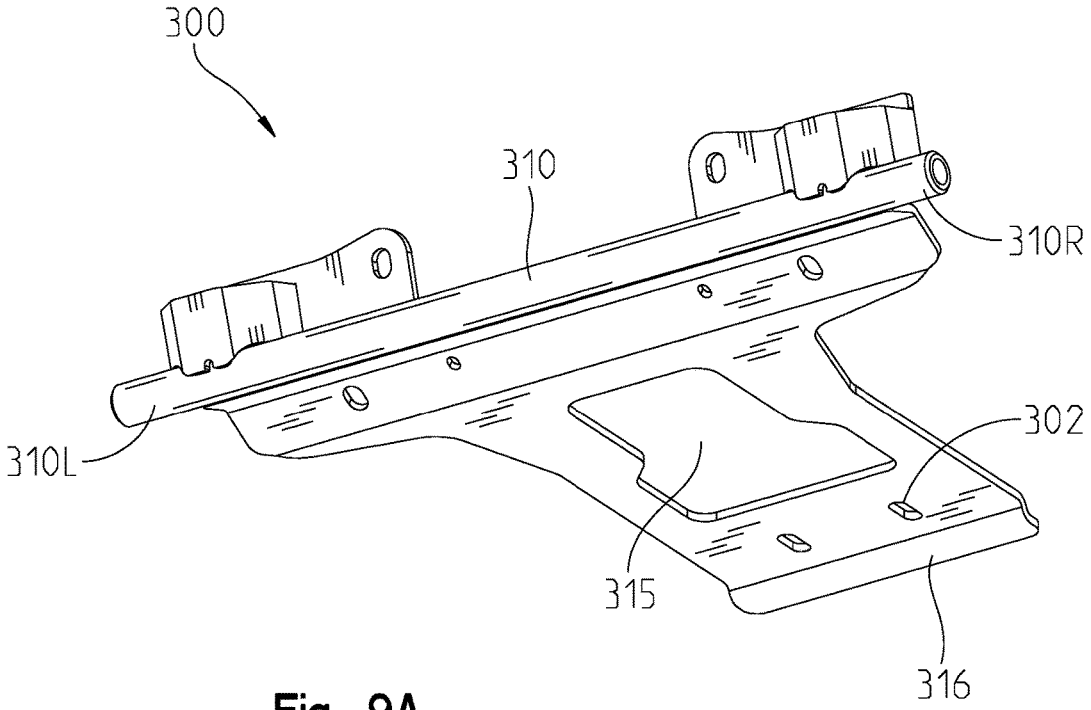
FIG. 9A shows a perspective view of an alternate vehicle subframe of the plow system of FIG. 1.

As can be seen in FIG. 9A, vehicle subframe 300 comprises an opening 315 vertically below and/or longitudinally rearward of mounting rod 310. Opening 315 may receive frame components (not shown) or body components (not shown) of vehicle 10 or may further be for reducing the weight of vehicle subframe 300. Vehicle subframe 300 further comprises a tab 316 which may be inserted into a frame or body component of vehicle 10 or may further be profiled to cover a portion of vehicle 10.

Figure 9B:
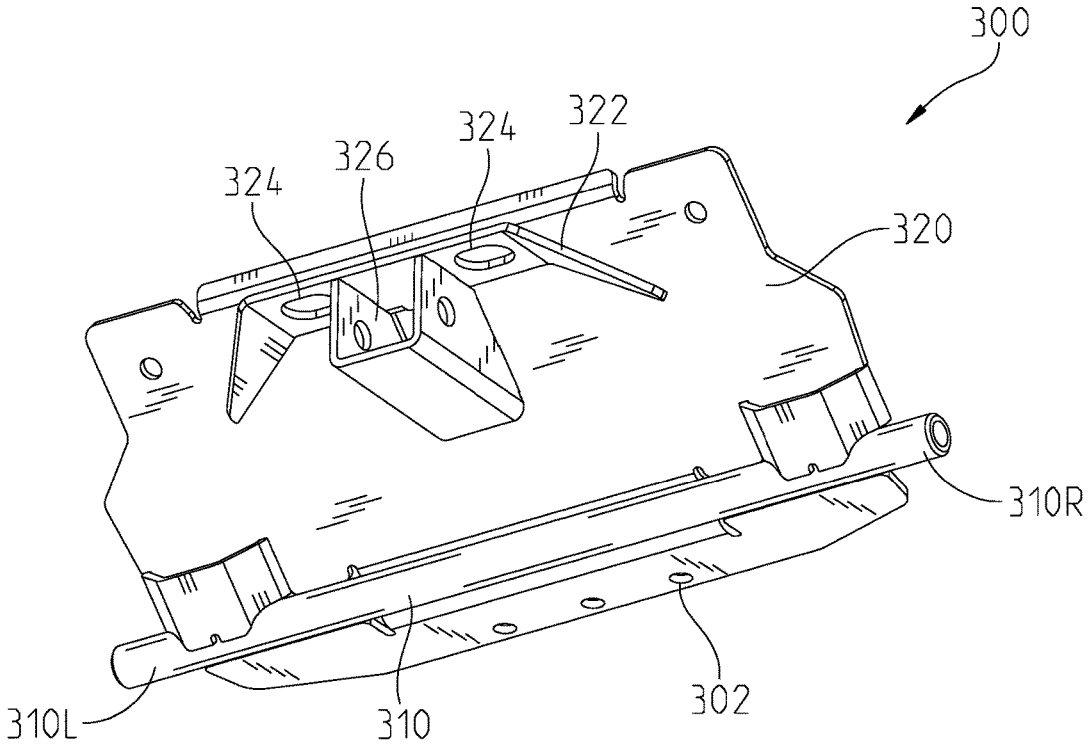
FIG. 9B shows a perspective view of an alternate vehicle subframe of the plow system of FIG. 1.

As can be seen in FIG. 9B, vehicle subframe comprises an upper plate 320 configured to profile a forward portion of vehicle 10. Upper plate 320 comprises a support plate 322 which may support a hitch receiving member 326. Hitch receiving member may provide support to receive a hitch (not shown) or other accessory (not shown). Further, support member 322 may comprise a plurality of mounting holes 324 which may be configured to receive a hook, a clevis, a bolt, or other types of fasteners.

Figure 9C:
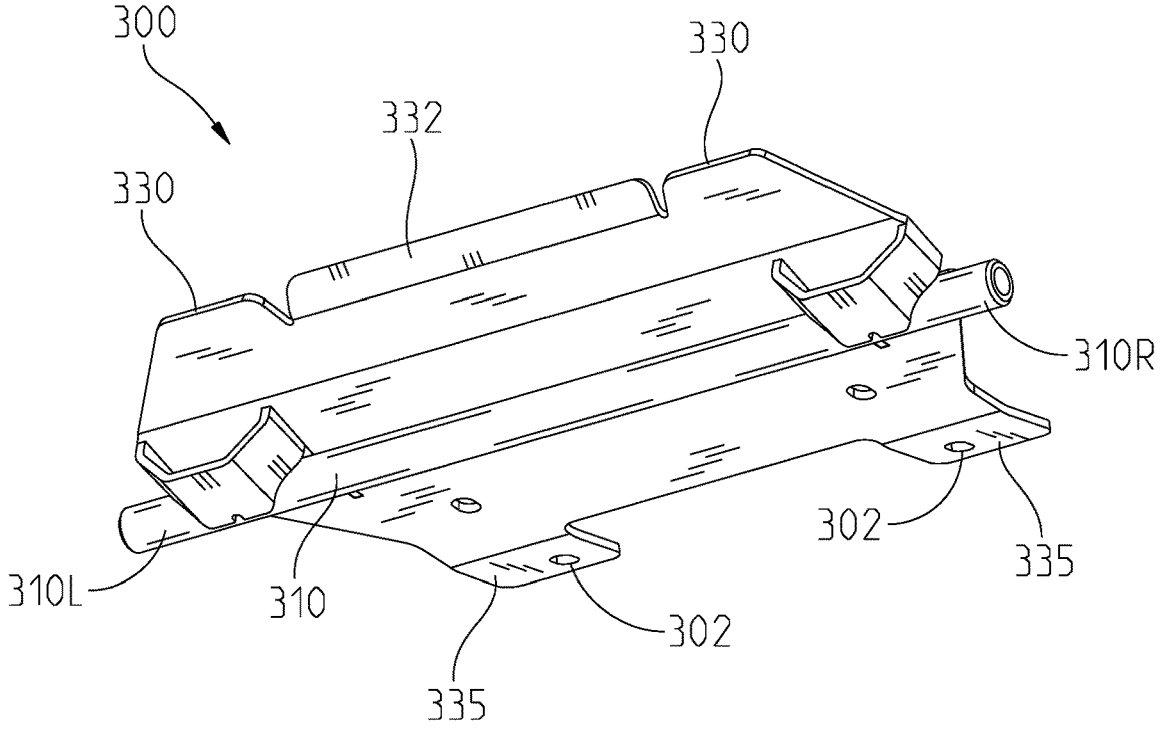
FIG. 9C shows a perspective view of an alternate vehicle subframe of the plow system of FIG. 1.

As can be seen in FIG. 9C, the present embodiment of vehicle subframe 300 comprises a plurality of outer tabs 330 and a center tab 332 above and/or in front of mounting rod 310. Outer tabs 330 and center tab 332 may be configured to interface with a portion of a frame of vehicle 10. Vehicle subframe 300 further comprises a plurality of lower tabs 335 that are positioned below and/or rearward of mounting rod 310. These tabs may be configured to be positioned on either side of a frame or body component of vehicle 10. Lower tabs 335 may further comprise openings 302 configured to receive fasteners to couple vehicle subframe 300 to vehicle 10.

Figure 9D:
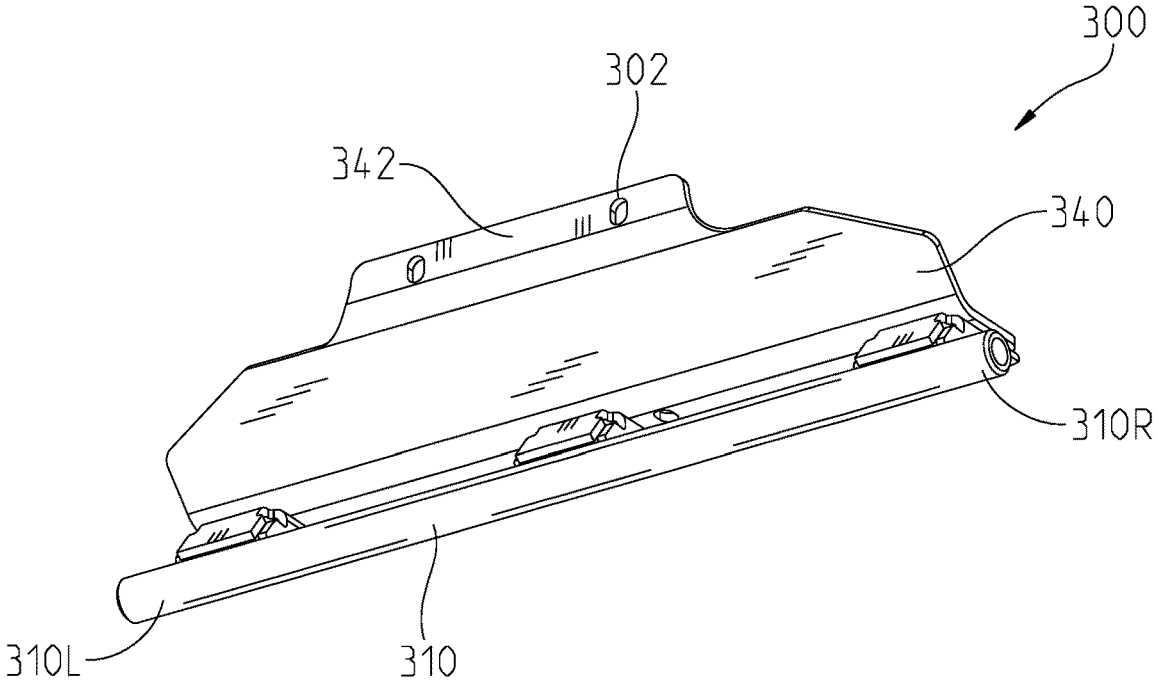
FIG. 9D shows a perspective view of an alternate vehicle subframe of the plow system of FIG. 1.

As can be seen in FIG. 9D, the present embodiment of vehicle subframe 300 comprises an upper plate 340 configured with an upper tab 342 configured with openings 302. In this way, vehicle subframe 300 is able to be mounted to a vehicle 10 with mounting locations above and/or in front of mounting rod 310.

Figure 9E:
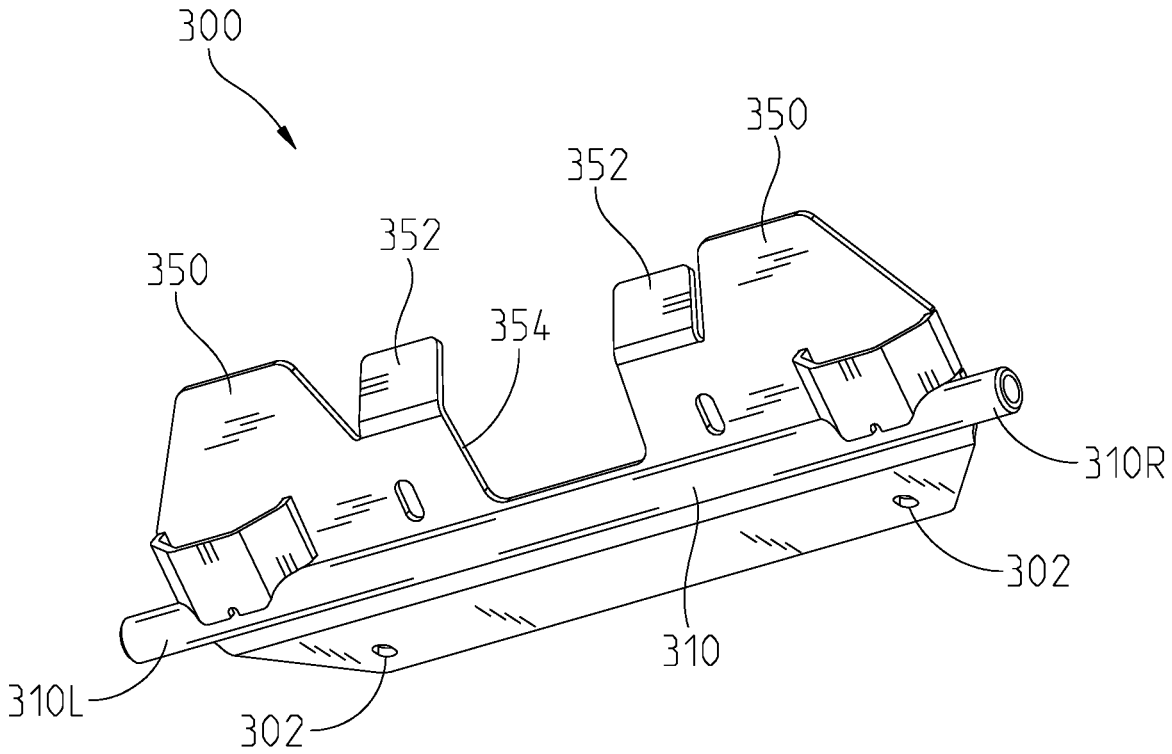
FIG. 9E shows a perspective view of an alternate vehicle subframe of the plow system of FIG. 1.

As can be seen in FIG. 9E, the present embodiment of vehicle subframe 300 comprises a pair of upper plates 350 configured with a plurality of tabs 352 located longitudinally forward and/or vertically above mounting rod 310. The pair of upper plates are configured to create an opening 354 which may receive a frame or body component of 354 or may further be configured to allow a winch (not shown) pass through vehicle subframe 300. Upper plates 350 and tabs 352 may be configured to cooperate with portions of the frame or body of vehicle 10.

During operation of vehicle 10, when the operator wishes to use plow system 100, plow system 100 may already be attached to vehicle 10 or may be coupled thereto by connecting 200 to 300. Operator may connect plow subframe 200 to vehicle subframe 300 by rotating lever 230 which in turn rotates left lever arm 232L and right lever arm 232R and allows left mount receiver 217L and right mount receiver 217R to be unobstructed. Operator may then position left mount receiver 217L and right mount receiver 217R to receive left mounting portion 310L and right mounting portion 310R, respectively, and position left mounting portion 310L and right mounting portion 310R within left mount receiver 217L and right mount receiver 217R, respectively. Operator may then lock left mounting portion 310L and right mounting portion 310R within left mount receiver 217L and right mount receiver 217R by rotating lever 230 around lever rotation axis 50 such that left lever arm 232L and right lever arm 232R obstruct left mount receiver 217L and right mount receiver 217R, respectively, and thus prohibit left mounting portion 310L and right mounting portion 310R from moving.

Once plow system 100 is coupled to vehicle 10, the position of blade 102 may be adjusted according to the conditions under which plow system 100 is operating and according to the height of vehicle 10. For example, if it is desired that blade 102 be positioned to create the highest level of contact with the ground, or if the height of vehicle 10 was increased, then the operator may adjust the position of fastener 215 within first adjustment aperture 250 and second adjustment apertures 251 so that third fastener 215 is positioned in first adjustment aperture 250 and second lower adjustment aperture 251C, adjust the position of first fastener 213A within third adjustment aperture 252 and fourth adjustment apertures 253 so that first fastener 213A is positioned within third adjustment aperture 252 and fourth lower adjustment aperture 253C, and adjust the position of second fastener 213B within sixth adjustment aperture 255 and fifth adjustment apertures 254 so that second fastener 213B is positioned within sixth adjustment aperture 255 and fifth lower adjustment aperture 254C to bring blade 102 to the lowest position. However, if conditions indicate that blade 102 should be positioned higher than the lowest position so that the plow might be above the ground (e.g. plowing a gravel driveway), or the height of vehicle 10 was lowered, then the operator may adjust the position of fastener 215 within first adjustment aperture 250 and second adjustment apertures 251 so that third fastener 215 is positioned in first adjustment aperture 250 and second middle adjustment aperture 251B, adjust the position of first fastener 213A within third adjustment aperture 252 and fourth adjustment apertures 253 so that first fastener 213A is positioned within third adjustment aperture 252 and fourth middle adjustment aperture 253B, and adjust the position of second fastener 213B within sixth adjustment aperture 255 and fifth adjustment apertures 254 so that second fastener 213B is positioned within sixth adjustment aperture 255 and fifth middle adjustment aperture 254B to bring blade 102 to the intermediate position. Further, if conditions indicate that blade 102 should be positioned higher than the intermediate position so that the plow might be higher above the ground, or if the height of vehicle 10 was lowered, then the operator may adjust the position of fastener 215 within first adjustment aperture 250 and second adjustment apertures 251 so that third fastener 215 is positioned in first adjustment aperture 250 and second upper adjustment aperture 251A, adjust the position of first fastener 213A within third adjustment aperture 252 and fourth adjustment apertures 253 so that first fastener 213A is positioned within third adjustment aperture 252 and fourth upper adjustment aperture 253A, and adjust the position of second fastener 213B within sixth adjustment aperture 255 and fifth adjustment apertures 254 so that second fastener 213B is positioned within sixth adjustment aperture 255 and fifth upper adjustment aperture 254A to bring blade 102 to the highest position.

While the present invention has been described in the context of a plow system 100 comprising a blade 102, it is understood that the present invention could be applied to a variety of accessories or implements commonly used with utility vehicles including, but not limited to, a mower, snow blower, brush mower, stump cutter, disc plow, cultivator, rake, power rake, spreader.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

The invention claimed is:

1. A plow system for a vehicle, comprising:

a main frame;

a blade operably coupled to the main frame;

the main frame comprising a first mounting portion and a second mounting portion configured to couple with the vehicle;

a lever operably coupled with the main frame and being configured to move from a first position to a second position, the lever including a main lever portion, a first arm portion, and second arm portion, the lever rotatable about a single rotational axis; and when the lever is in the first position, the first arm portion of the lever covers the first mounting portion and the second arm portion of the lever covers the second mounting portion, and when the lever is in the second position, the lever allows access to both the first mounting portion and the second portion.

2. The plow system of claim 1, wherein the lever further comprises a first hook portion configured to cover the first mounting portion and a second hook portion configured to cover the second mounting portion.

3. The plow system of claim 1, wherein the main frame is configured with a plurality of adjustment apertures that allow vertical adjustment of the plow blade relative to the first and second mounting portion.

4. The plow system of claim 1, further comprising a vehicle subframe coupled to the vehicle, the vehicle subframe comprising a third mounting portion and a fourth mounting portion; and the first mounting portion is configured to engage the third mounting portion and the second mounting portion is configured to engage the fourth mounting portion.

5. The plow system of claim 4, wherein the vehicle subframe extends from a position behind a steering system of the vehicle to a position in front of a vehicle front suspension.

6. The plow system of claim 1, wherein the main frame is operably coupled to a plurality of mounting plates, and the plurality of mounting plates engage a vehicle subframe.

7. An implement mounting system for a vehicle, comprising:

a main frame configured to receive an implement at a forward end of the main frame;

a vehicle subframe configured to receive the main frame;

at least one adjustment bracket coupled to the main frame, the at least one adjustment bracket comprising a plurality of mounting apertures;

a lever comprising a handle and a lever arm, the lever rotatably coupled to the adjustment bracket about a single rotational axis, a portion of the lever being configured to engage the vehicle subframe;

at least one pin configured to couple the lever with the at least one adjustment bracket; and wherein the handle and the lever arm are configured to rotate about the single rotational axis.

8. The implement mounting system of claim 7, wherein a portion of the plurality of mounting apertures are vertically spaced from one another.

9. The implement mounting system of claim 7, wherein the lever is operable between a first position and a second position, wherein in the first position the lever cooperates with the adjustment bracket to allow access to a receiving portion of the adjustment bracket.

10. The implement mounting system of claim 7, wherein the adjustment bracket comprises a plurality of discrete mounting positions vertically spaced from each other.

11. The implement mounting system of claim 7, wherein the main frame further comprises a first mounting portion and a second mounting portion; and the first mounting portion comprises a first adjustment bracket and the second mounting portion comprises a second adjustment bracket.

12. The implement mounting system of claim 11, wherein the lever has a first lever arm operably coupled to the first adjustment bracket and a second lever arm operably coupled to the second adjustment bracket.

13. The implement mounting system of claim 7, wherein the lever is rotatable relative to the adjustment bracket.

14. The implement mounting system of claim 7, wherein the implement is one of a plow, a mower, a snow blower, a brush mower, a stump cutter, a disc plow, a cultivator, a rake, a power rake, and a spreader.

15. A frame assembly for coupling an accessory to a vehicle, comprising:

a main frame comprising a front portion and a rear portion, the accessory being configured to be coupled to the main frame adjacent to the front portion, and the accessory having an adjustable height relative to the ground when coupled to the main frame, the main frame defining a plurality of main frame apertures;

at least one adjustment bracket coupled to the rear portion, wherein the adjustment bracket comprises a plurality of adjustment bracket apertures; and at least a first portion of the adjustment bracket apertures are configured to align with at least a first portion of the main frame apertures in a first position giving the accessory a first height relative to the ground, wherein the at least one adjustment bracket is coupled to the main frame at the first portion of adjustment bracket apertures that correspond to the first portion of main frame apertures, the first portion of main frame apertures comprising at least a pair of longitudinally offset apertures, and at least a second portion of the adjustment bracket apertures are configured to align with at least a second portion of the main frame apertures in a second position giving the accessory a second height relative to the ground, the first height is distinct from the second height.

16. The frame assembly of claim 15, further comprising a third portion of adjustment bracket apertures configured to align with a third portion of main frame apertures in a third position giving the accessory a third height relative to the ground, wherein the third height is distinct from the first and second height.

17. The frame assembly of claim 15, wherein a lever is coupled to the at least one adjustment bracket and is configured to rotate about a rotation axis.

18. The frame assembly of claim 17, wherein the rotation axis intersects the at least one adjustment bracket.

19. The frame assembly of claim 15, wherein the rear portion comprises a first mounting bracket and a second mounting bracket configured to receive the at least one adjustment bracket therebetween.

20. The frame assembly of claim 15, wherein the plurality of main frame apertures comprise a first main frame aperture, a second main frame aperture vertically offset from the first main frame aperture, and a third main frame aperture longitudinally offset from the first main frame aperture, and the plurality of adjustment bracket apertures comprise a first adjustment bracket aperture, a second adjustment bracket aperture vertically offset from the first adjustment bracket aperture, and a third adjustment bracket aperture longitudinally offset from the first adjustment bracket aperture.

* * * * *